United States Patent [19]

Hartness et al.

[11] 4,177,619

[45] Dec. 11, 1979

[54] CASE INDEXING APPARATUS

[76] Inventors: Thomas P. Hartness, 305 Bridgewater Dr.; Robert G. Hartness, 203 Wilmington Rd., both of Greenville, S.C. 29615

[21] Appl. No.: 839,798

[22] Filed: Oct. 6, 1977

[51] Int. Cl.[2] ..... B65B 5/06; B65B 21/16

[52] U.S. Cl. ..... 53/250; 53/64; 53/539; 198/474

[58] Field of Search ..... 53/61, 62, 64, 166, 53/247, 248, 249, 250, 251; 198/474, 736, 747, 859

[56] References Cited

U.S. PATENT DOCUMENTS

| | | | |
|---|---|---|---|
| 1,557,350 | 10/1925 | Stebler | 198/474 X |
| 1,850,418 | 3/1932 | Sankey | 198/474 |
| 2,952,955 | 9/1960 | Leichenich et al. | 53/166 X |
| 3,237,751 | 3/1966 | Jonassen | 198/474 |
| 3,339,706 | 9/1967 | Arvidson | 198/474 |
| 3,383,833 | 5/1968 | Pearson | 53/250 X |
| 3,645,069 | 2/1972 | Waite | 53/247 X |
| 3,694,993 | 10/1972 | East | 53/247 X |

*Primary Examiner*—Travis S. McGehee

*Attorney, Agent, or Firm*—Bailey, Dority & Flint

[57] ABSTRACT

An apparatus for controlling the feeding of cases into an article handling machine from a moving conveyor which feeds a continuous line of cases thereto. The apparatus includes an abutment carried in the path of flow of the cases. The abutment extends above the conveyor for engaging a front end of a first case of said line of cases stopping the forward movement of the cases on the conveyor. A movable post is carried below the front end of the case and is selectively raised for lifting the front end of the case over the abutment so that the case can be indexed forwardly on the conveyor and into the article handling machine.

3 Claims, 10 Drawing Figures

CASE INDEXING APPARATUS

BACKGROUND OF THE INVENTION

The present invention relates to an apparatus for indexing cases into an article handling machine and, more particularly, to an apparatus for indexing cases from a conveyor into the article handling machine.

Heretofore, indexing devices for article handling machines such as case loaders and unloading machines incorporated movable stops that are moved into the path of the case for holding the case back while the previous case is being fed into the article handling machine. An example of one type of case loader is disclosed in U.S. Pat. No. 3,353,331. In this particular device, the empty cases are fed on a conveyor and a movable arm actuated by an air cylinder shifts a flange in the path of the oncoming conveyors for holding back the line of conveyors as the leading case is inserted on an elevator. While the case is on the elevator, bottles are loaded therein.

In U.S. Pat. No. 2,799,414, there is disclosed an apparatus for feeding cases of bottles and the like to a case unloader. These cases are fed on a conveyor adjacent to the unloading machine and are shifted laterally onto a platform associated with the unloading mechanism. The cases being fed in on the conveyor are separated by means of pushbars 12.

In U.S. Pat. No. 3,986,321, there is disclosed a case loading machine which utilizes another type of case indexing mechanism. In this particular device, a cam means abuts against the front end of the leading case for stopping the empty case on an elevator platform. After the bottles have been loaded into the empty case, the cam is lowered allowing the case to be pushed out of the bottle loading machine.

Other similar box loading and conveying machines are disclosed in U.S. Pat. Nos. 2,578,277, 2,681,171, and 2,713,448.

In the most commonly used case loading device known to applicants, the conveyor, which is used for shifting the empty cases into a case loading machine, is equipped with a clutch and braking mechanism which is selectively energized and de-energized for feeding the cases into the bottle loading machine. One problem with such devices is that it requires accurate timing to stop and start the movement of the conveyor in order to properly position an empty case for being loaded.

SUMMARY OF THE INVENTION

The invention pertains to an apparatus for controlling the feeding of cases into an article handling machine from a moving conveyor which feeds continuous lines of cases. The apparatus includes an abutment carried in the flow path of the cases. The abutment extends above the run of the conveyor for engaging a front end of the leading case for stopping the forward movement of the case on the conveyor. Means is provided for selectively raising the front end of the case above the abutment so that the next following case on the conveyor pushes the first case over the abutment into the article handling machine.

Accordingly, it is an object of the present invention to provide a device for positively indexing cases being fed to an article handling machine.

Another important object of the present invention is to provide an apparatus for indexing cases of various lengths into an article loading or unloading machine.

Still another important object of the present invention is to provide a simple and accurate case indexing mechanism for an article handling machine.

These and other objects and advantages of the invention will become apparent upon reference to the following specification, attendant claims, and drawings.

DESCRIPTION OF THE PREFERRED EMBODIMENT

Figure 1:
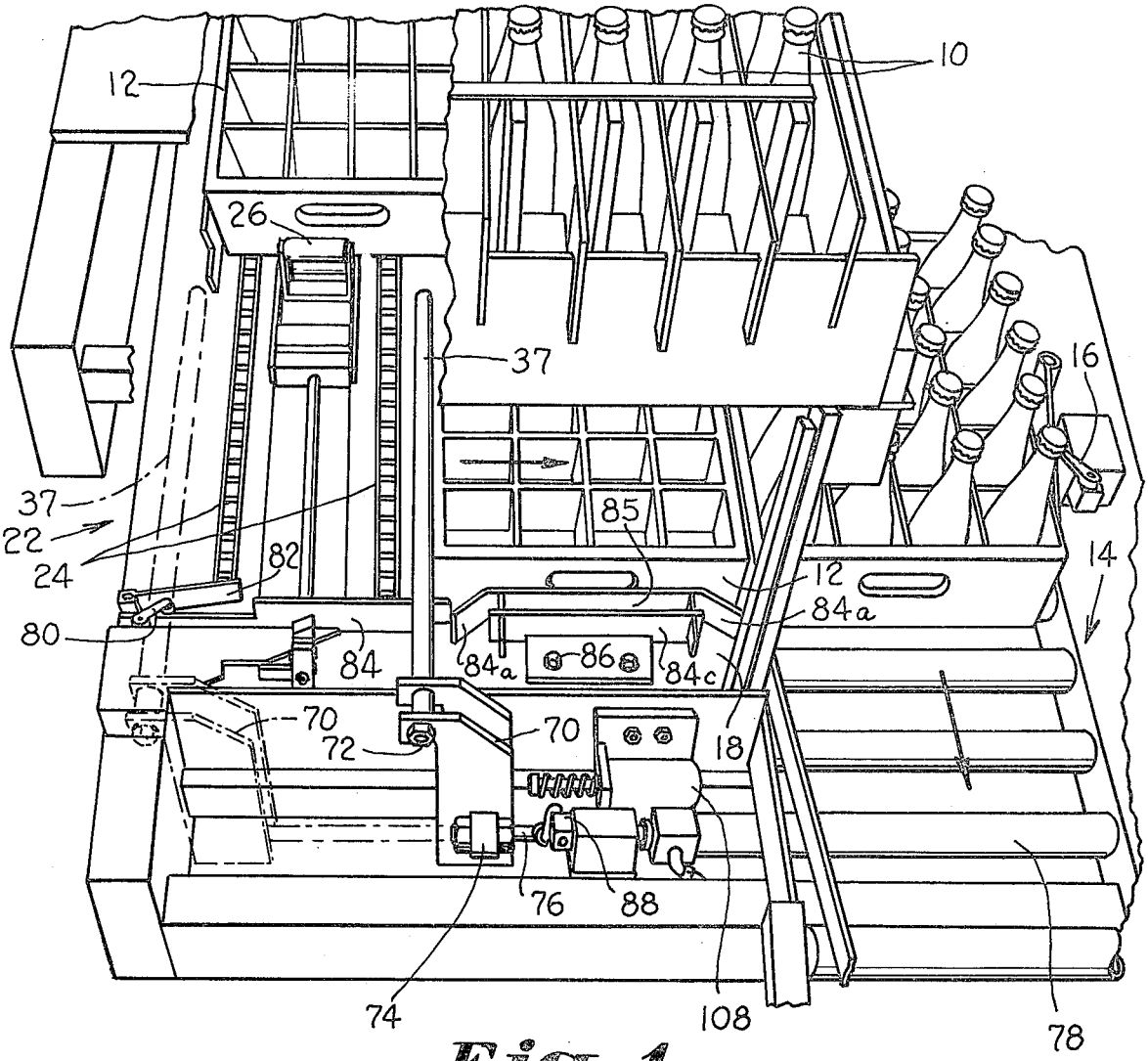
FIG. 1 is a perspective view illustrating a portion of a case loading machine equipped with an indexing mechanism constructed in accordance with the present invention.

Referring in more detail to FIG. 1 of the drawings, there is illustrated a portion of a case loading machine wherein bottles 10 that are to be loaded into empty cases are carried on top of a shiftable rack above an empty case 12 into which they are to be loaded. After the bottles have been deposited into the empty case 12, the case is shifted to the right onto another conveyor generally designated by the reference character 14 for being transported. A switch 16 is engaged by the loaded case for stopping the bottle loading operation until the loaded case has been shifted forward by the running conveyor 14. This is to prevent loading of cases when there is a back-up of cases on conveyor 14.

The empty case 12 as illustrated in FIG. 1 is supported on an elevator platform 18 such as shown schematically in FIG. 10 which is raised to a position directly below the bottles 10 during the loading operation. After the elevator has been raised, a rack which supports the bottles 10 is shifted laterally dropping the bottles into the empty case. After a predetermined period of time, a timer times out allowing air to be supplied to a pneumatic cylinder 20 for lowering the filled case.

The apparatus forming the present invention may be incorporated in any conventional article handling machine such as a bottle loading machine shown in U.S. Pat. No. 3,788,034. It can also be utilized with bottle unloading machines.

Empty cases 12 are fed to the article handling machine by means of a continuously running conveyor 22 which includes a pair of spaced driven conveyor chains 24. The cases which are fed in a continuous line are transported on the chains 24 to the case packing machine.

The leading case in the row is moved forward on the conveyor until it abuts against an abutment 26 carried between the conveyor chains 24. The abutment 26 includes a pair ofspaces supporting arms 28 and 30 which has a roller 32 journaled adjacent the upper end thereof. The lower end of the arms 28 and 30 are, in turn, welded to a horizontally extending supporting member 34.

Figure 4:
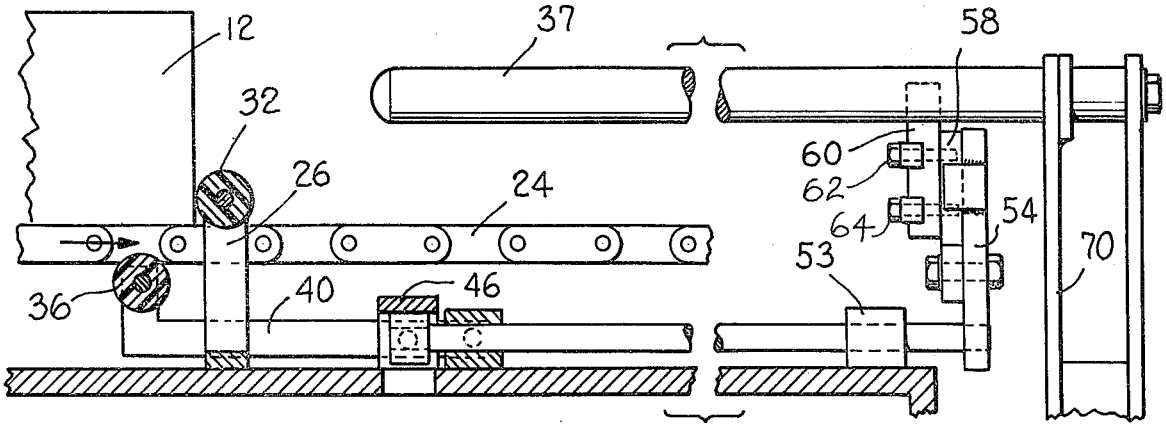
FIG. 4 is a side elevational view, partially in section, illustrating a case indexing mechanism as well as a rake utilized for shifting cases onto an article loading machine.
Figure 5:
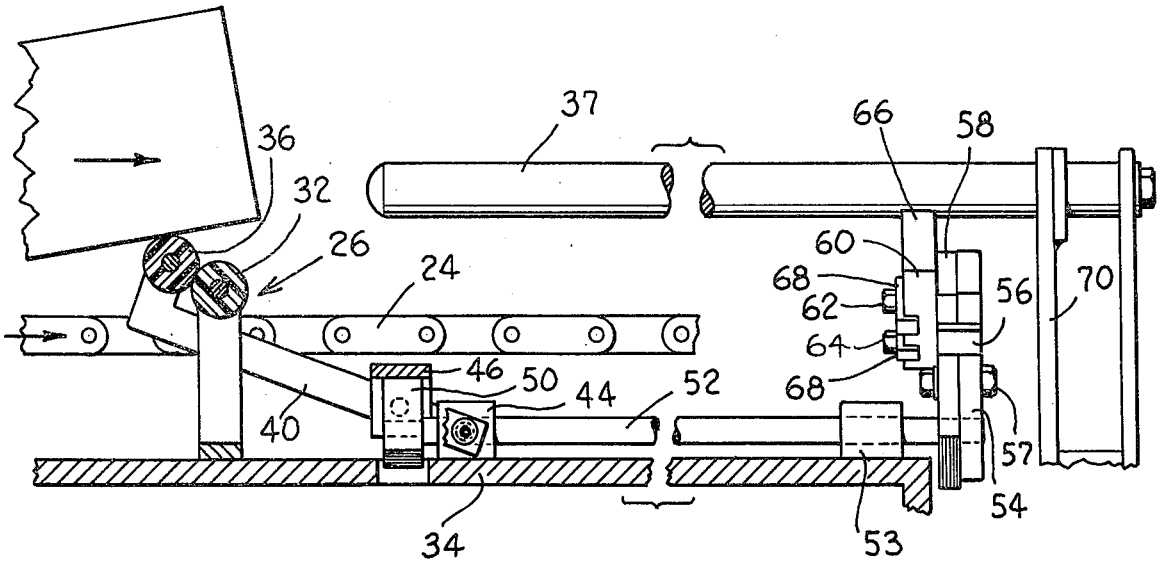
FIG. 5 is a side elevational view, partially in section, illustrating a case being indexed over an abutment.
Figure 6:
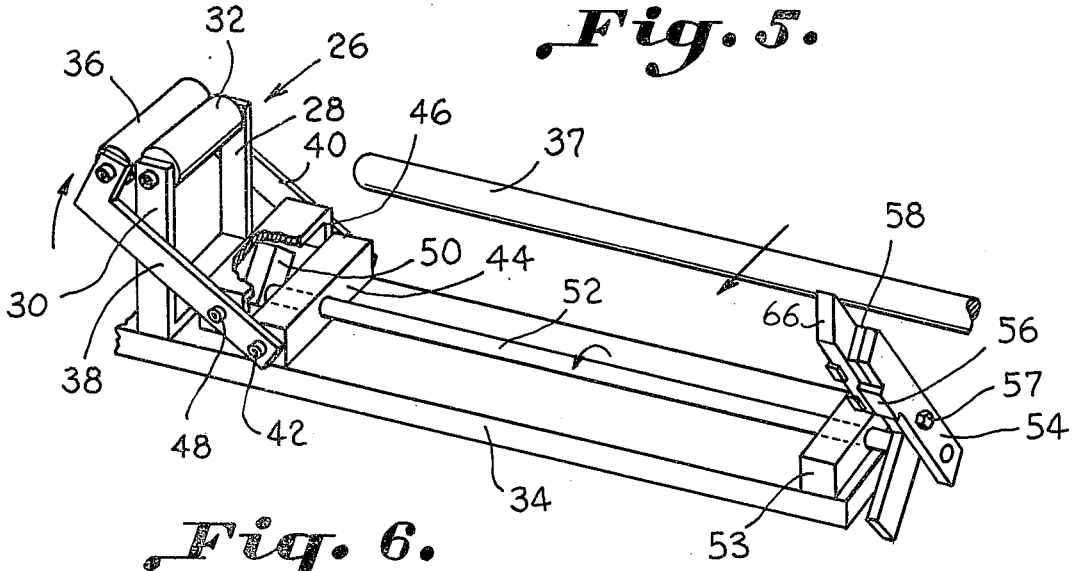
FIG. 6 is an enlarged perspective view of the indexing mechanism removed from the conveyor system for purposes of clarity.

As illustrated in FIGS. 4 through 6, the abutment 26 forms part of an indexing mechanism for the cases. Since the conveyor chains 24 are running continuously, the front end of the case 12 is pushed flush against the roller 32. In order to index the case forward into a position where it can be shifted by means of a rake 37 onto the elevator platform of the case loading machine, it is necessary that the front end of the case be lifted up over the roller 32.

This is accomplished by means of a mechanically operated camming mechanism that includes a roller 36 carried between a pair of L-shaped arms or parts 38 and 40. The other end of the L-shaped arms 38 and 40 are journaled on pins 42 extending outwardly from a supporting block 44 which is, in turn, secured to the base member 34 by any suitable means such as welding. A rectangular housing 46 is carried between the lower ends of the arms 38 and 40 on pins 48. The housing 46 has an opened bottom. Inside the housing 46 is a rotatable cam member 50 that is fixed to an end of a shaft 52. The shaft 52 extends through a hole in the block 44 and another block 53. The other end of the shaft is fixed to an upwardly extending lever 54. A laterally extending abutment 56 is welded to an inner edge of the lever 54 and extends laterally therefrom. Positioned adjacent the lever 54 is another pivotal lever 58 that is journaled on a bolt 57 carried by lever 54. A nylon upwardly extending block 60 is secured to the lever 58 by means of bolts 62 and 64. The upper edge of the nylon block 60 is cut at an angle as illustrated at 66. Metal brackets 68 are interposed between the bolts 62 and 64 and the nylon block 60 for positively securing the block 60 to the metal member 58.

Figure 2:
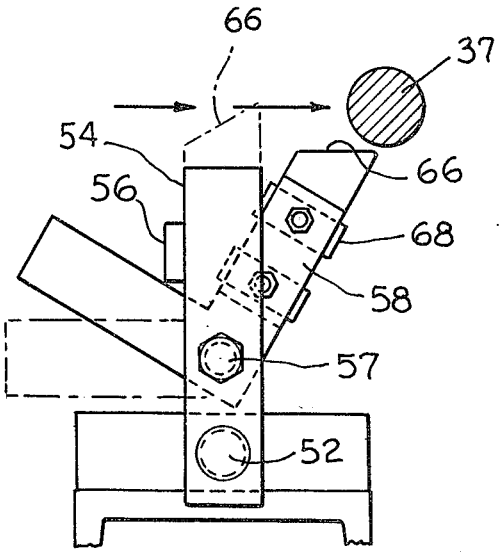
FIG. 2 is an enlarged elevational view of a mechanism for activating the indexing mechanism shown in a non-indexing position.

As illustrated in FIG. 4, the upper inclined edge 66 of the post 60 extends upwardly into the path that is traveled by the rake 37. As a result, when the rake is shifted to the right as illustrated in FIG. 1, the lower surface of the rake 37 which is in the form of a circular rod rides over the inclined surface 66 pivoting the block 58 in a clockwise direction as illustrated in FIG. 2. Since the block 58 is pivotally secured to the vertically extending member 54 on the bolt 57, the vertically extending block 54 remains in the vertical position.

Figure 3:
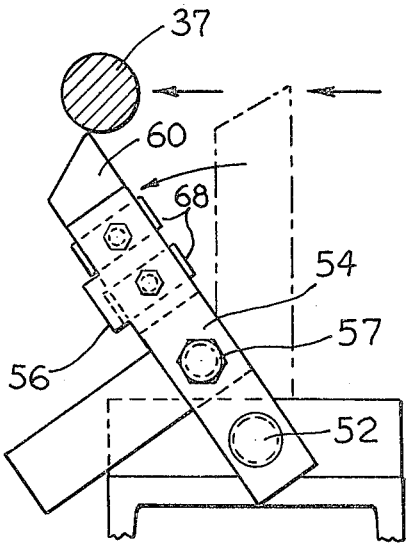
FIG. 3 is an enlarged elevational view of the mechanism of FIG. 2 shown in an indexing position.

However, upon the rake 37 returning back to its initial phantom line position such as illustrated in FIG. 1, it engages the front edge of the nylon block 60 pivoting it counterclockwise, such as illustrated in FIG. 3.

As the nylon block 60 is pivoted counterclockwise, it engages the laterally extending abutment 56 fixed to the vertical member 54 rotating the vertical member 54 in a counterclockwise direction as illustrated in FIG. 3. As the vertical member 54 is rotated in a counterclockwise direction, it, in turn, rotates the elongated shaft 52 in a counterclockwise direction. This causes the cam member 50 carried within the housing 46 to be rotated raising the housing 46. As the housing 46 is raised, it lifts the arms 38 and 40 raising the roller 36 upwardly as illustrated in FIG. 5 to engage the bottom of the next following case. The roller 36 raises the case above the roller 32 forming part of the abutment 26, causing the case to be lifted over the abutment.

The following cases and the moving conveyor chain 24 causes the case to be pushed forward over the abutment so that it can be subsequently indexed into the article handling machine by means of the rake 37. After the rake 37 passes to the left beyond the upwardly extending member 60, the weight of the roller 36, the arms 38 and 40, and the housing 46 causes the vertically extending member 54 to be returned to its initial vertical position.

When the lever arm 54 returns to its vertical position and the roller 36 has dropped back below the conveyor chain 24, the next case moves up and abuts against the abutment roller 32.

The rake 37 is carried on an upwardly extending bracket 70 which includes a pair of spaced plates. The rake is secured thereto by means of threads and a nut 72. The lower end of the bracket is, in turn, bolted by means of bolts 74 to an end of a piston rod 76. The piston rod extends through a horizontally extending member which connects the two spaced plates of the bracket 70 together.

The piston rod, in turn, is carried by a pneumatically operated cylinder 78 which is controlled by a microswitch 80 that is closed by the case 12 after it is lifted over the abutment 32 and fed forward. The front end of the case strikes a pivotal plate 82 which, in turn, pushes the microswitch 80 forward closing the switch. When the microswitch 80 is closed, it, in turn, energizes a solenoid valve which connects one port of the cylinder 78 to a source of pressure for causing the piston to be retracted, thus moving the rake 37 to the right to the full line position shown in FIG. 1.

The hinge plate 82 is carried adjacent a wall 84 which stops or limits the forward movement of the cases 12 on the conveyor 22. In alignment with the wall and positioned on the elevator 18 is another guide plate 85 which has inclined flanges 84*a* on the ends thereof for aiding in properly positioning the case 12 on the elevator. The guide plate 85 may be adjusted laterally by loosening the bolts 86. The bolts extend through slots provided in a horizontal flange connected to guide plate 85.

After the case has been shifted onto the elevator 18 by the rake 37, the bracket 70 which supports the rake strikes another microswitch 88 which causes two operations to occur. First, it de-energizes the solenoid valve which operated the cylinder 78 for shifting the rake to the right, then it closes another valve allowing air to flow into the other end of the cylinder 78 for returning the rake to its initial position shown in phantom lines in FIG. 1. The closing of microswitch 88 also energizes another solenoid valve 90 that connects the main elevator cylinder 20 to a supply of pressurized air 92, see FIG. 10. When this occurs, the piston 94 carried within the cylinder 20 is lowered pushing one end of a pivotal arm 96 downwardly. A weight 98 is carried on the remote end of the pivotal arm 96 for producing a balanced load. The pivotal arm is pivoted on pivot 100. The inner end of the pivotal arm 96 is pivotally secured to a downwardly extending bracket 102 that is connected to the bottom side of the elevator 18. Thus, when the piston 94 is lowered, this causes the elevator platform 18 to be raised to the loading position. The elevator platform 18 remains in this raised loading position for a period of time sufficient to allow the bottles 10 to be dropped into the case. This period of time is controlled by a timer mechanism associated with the valve 104.

After a short duration, the valve 104 then supplies air to the lower port 106 of the cylinder 20. This causes the piston 94 to be raised within the cylinder 20 thus lowering the elevator 18 and the case with the bottles therein.

Figure 10:
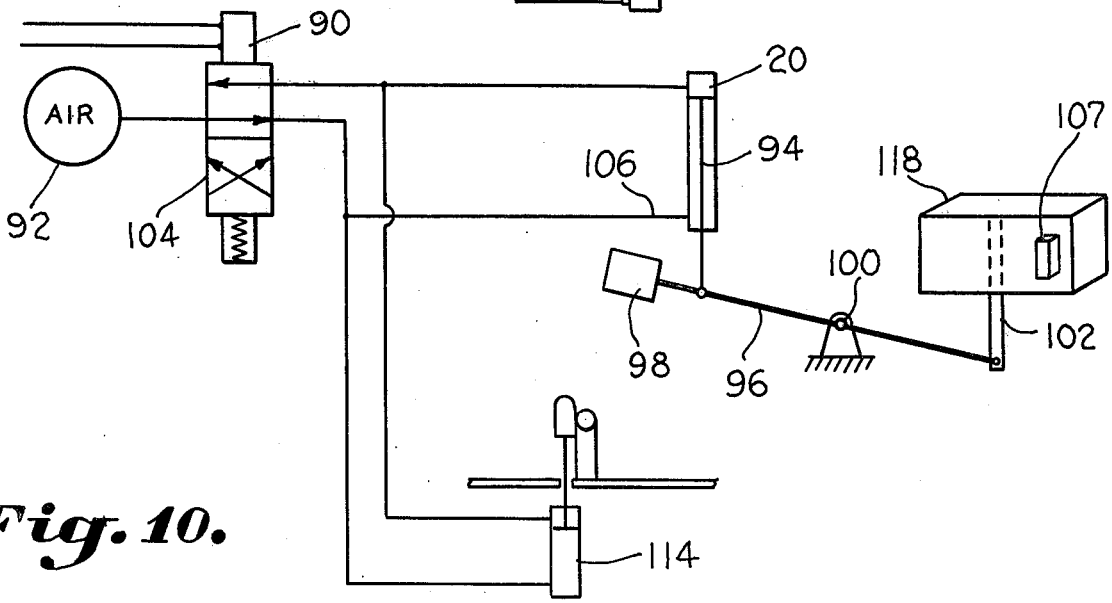
FIG. 10 is a schematic diagram illustrating the fluid flow system for operating the indexing mechanism of FIGS. 7, 8 and 9.

An abutment 107 as seen in FIG. 10, is carried on the side of the elevator 18 and when raised extends into the path of the conveyor so as to stop the case from being shifted forward therebeyond. As long as the elevator 18 is in the up position, the abutment 104 will prevent the case from striking the hinge plate 82. However, upon the elevator being lowered completely, the abutment 104 will drop below the leading edge of the incoming case allowing the conveyor to shift the case forward to strike the hinge plate 82. Upon striking the hinge plate 82, the rake is then shifted back to the right and the new case forces the filled case off of the elevator onto the conveyor 14.

A shock absorbing member 108 is carried in the path of the vertically extending plate 70 which support the rake 37 so as to gradually stop the rake when it reaches the position wherein the case 12 is properly positioned on the elevator 18.

Figure 7:
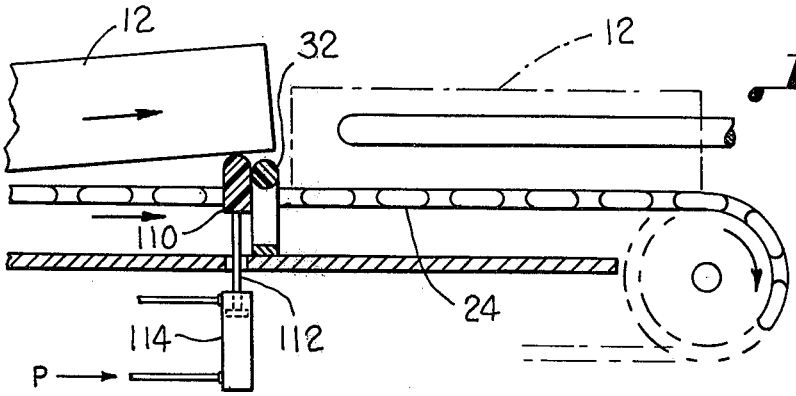
FIGS. 7, 8 and 9 are side elevational views of a modified form of the invention illustrating an indexing mechanism in various positions.
Figure 8:
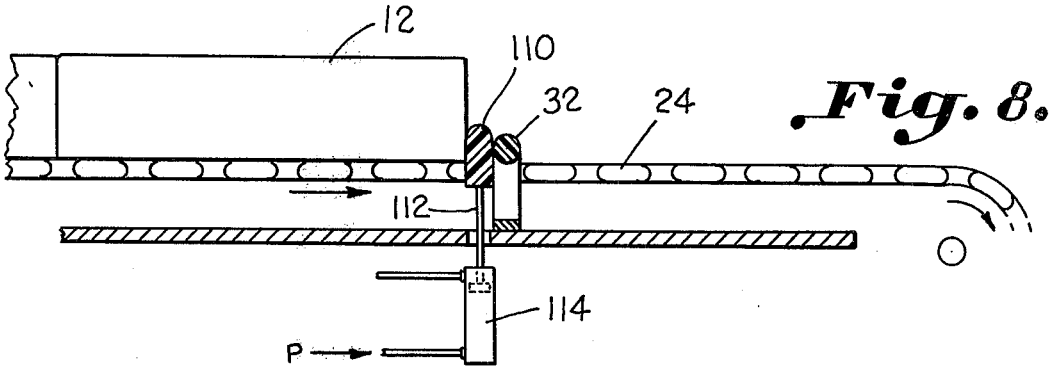
Figure 9:
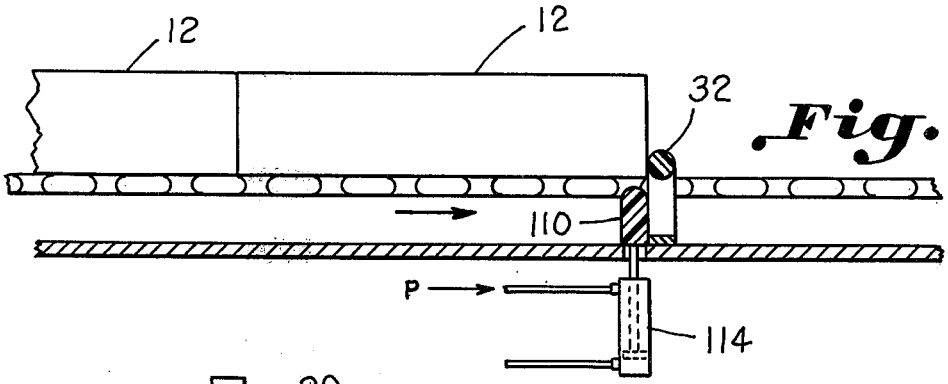

An alternate form of indexing the cases on the conveyor to a position where the rake can shift the case laterally onto the elevator platform 18 is illustrated in FIGS. 7 through 9. In this particular device, a cam means 110 is provided for raising the front end of the next following case for lifting it over the abutment 32. The cam means 110 includes a nylon post having a curved upper surface. The post is carried on top of a piston rod 112 which is, in turn, manipulated by means of a pneumatically operated cylinder 114. The cylinder 114 is a double-acting cylinder so that when air is supplied in its upper port the cam 110 is lowered and when air is supplied to its lower port it is raised to the position illustrated in FIG. 8. The operation of the cylinder 114 as illustrated in FIG. 10 is synchronized with the raising and lowering of the elevator.

As illustrated in FIG. 10, when air is supplied to the upper port of the cylinder 20 which is used for raising the elevator 18, it is also simultaneously supplied to the upper port of the cylinder 114 which raises the cam means 110. When the cam means 110 is raised as illustrated in FIG. 7, it lifts the front end of the case 12 up over the abutment 32. The next following case pushes the case forward over the abutment until it strikes the block 107 carried on the side of the raised elevator 18. After a predetermined period of time, a timer associated with the pneumatic valve 104 times out and air is supplied to the lower ports of the cylinders 20 and 114. This lowers the elevator and also causes the cam means 110 to be retracted to the position illustrated in FIG. 9 below the run of the conveyor chains.

While the elevator is in the raised position wherein the bottles are being deposited into the case, the cam 110 is also in a raised position such as illustrated in FIG. 8, therefore, the next following case first strikes the raised cam 110 and then when the cam 110 and the elevator 18 is lowered it moves down below the path of travel of the cases and the case moves up against the abutment 32 as illustrated in FIG. 9.

In summarizing the operation of the case indexing mechanism, a continuous line of cases 12 are fed in on the conveyor as illustrated in FIG. 1. The case first strikes an upwardly extending abutment 32 such as illustrated in FIGS. 4 and 9. In order to lift the first case over the abutment 32 the hinge plate 82 must be pivoted so as to close the microswitch 80. When the microswitch 80 is closed the rake 37 shifts a case that is in the position adjacent the elevator platform 18 to the right onto the elevator platform. As the rake 37 moves to the right, the bracket 70 supporting the rake strikes the microswitch 88 causing air to be supplied to the other end of cylinder 78 which is used for returning the rake 37 to its initial position. It also supplies pressurized air to a pneumatic cylinder 20 for raising the elevator with the empty case so that the bottles can be deposited therein.

In the mechanical embodiment illustrated in FIGS. 1 through 6, as the rake comes back, it strikes the forward edge of the vertically extending member 60 pivoting such rearwardly. As the member 60 is pivoted rearwardly it engages an abutment 56 carried on the vertically extending arm 54 pivoting the vertically extending arm in a counter-clockwise direction such as illustrated in FIG. 3. This, in turn, rotates the elongated shaft 52 rotating the cam 50 carried within the housing 46. As the cam 50 is rotated it raises the housing 46 lifting the spaced arms 38 and 40 with the roller carried therebetween.

The roller 36 engages the bottom of the case lifting the case up over the abutment 32. The pressure from the following cases as well as the moving conveyor chains 24 shifts the case against the abutment 107 carried on a side wall of the elevator 18. This abutment keeps the case from engaging the hinge plate 82 until the elevator 18 is lowered completely. When the elevator 18 is lowered completely, the case is then moved forward by the conveyor chains 24 to strike the plate 82 for repeating the operation. Each time the rake 37 shifts an empty case onto the elevator, it strikes the previously filled case and shifts it out to the right thereof onto the conveyor 14.

The device shown in FIGS. 7 through 10 utilizes a pneumatically operated cam 110 for raising the fron end of the case 12 for lifting it over the abutment 32. The operation of the pneumatically operated cam 110 is synchronized with the elevator cylinder 20 such as illustrated in FIG. 10 by connecting the same air ports thereof to the same air lines.

While a preferred embodiment of the invention has been described using specific terms, such description is for illustrative purposes only, and it is to be understood that changes and variations may be made without departing from the spirit or scope of the following claims.

What is claimed is:

1. An apparatus for indexing an empty case into an article loading machine from a conveyor feeding a continuous line of empty cases positioned adjacent one side of said article loading machine, said article loading machine including an elevator platform which raises an empty case to a loading position wherein said articles are deposited therein, said apparatus comprising:

rake means for shifting said first empty case from a first position on said conveyor onto said elevator platform including, a rake, a fluid operated cylinder connected to said rake, means for activating said fluid operated cylinder connected to said rake upon a case being shifted into said first position causing said rake to shift said case onto said platform, cam means engaging the next following case carried on said conveyor preventing said next following case from being shifted forward while said first empty case is being shifted onto said elevator platform, means deactivating said cam means allowing said next following case to be shifted by said conveyor to said first position after said first empty case has been shifted onto said elevator, said cam means including, (i) an abutment carried in the path of said empty cases for engaging a front end of said next following case preventing said case from being shifted forward on said conveyor, said means for deactivating said cam means includes, (i) a post, (ii) means for selectively raising said post to engage the bottom of said next following case adjacent a front end thereof for lifting said front end above said abutment, and said means for selectively raising said post including, (i) a rotatable cam means engaging said post for raising said post upon being rotated lifting said front end of said next following case above said abutment.

2. The apparatus as set forth in claim 1 further comprising:

a shaft connected to said rotatable cam means, means for rotating said shaft and cam means upon said rake being returned to its initial position after shifting said case onto said platform.

3. An apparatus for indexing an empty case into anarticle loading machine from a conveyor feeding a continuous line of empty cases positioned adjacent said article loadingmachine, said article loading machine including an elevatorplatform, a source of pressurized fluid, a fluid operated cylinder connected to said elevator, and means for selectively supplying said pressurized fluid to said first fluid operated cylinder for raising said elevator platform and case carried thereon to a loading position, wherein said articles are deposited in said case and for lowering said elevator back to its initial lowered position, said apparatus comprising:

means for shifting a first empty case from a first position on said conveyor onto said elevator platform;

cam means engaging the next following case carried on said conveyor preventing said next following case from being shifted forward onto said elevator platform;

means de-activating said cam means allowing said next following case to be shifted over said cam means;

said cam means including, (i) an abutment carried in the path of said empty cases for engaging a front end of said next following case preventing said case from being shifted forward on said conveyor, said means for de-activating said cam means includes, (i) a second fluid operated cylinder, (ii) a piston operated rod extending out said second fluid operated cylinder under a bottom front end of said next following case, and (iii) means for selectively supplying pressurized fluid from said source of pressurized fluid to said second fluid operated cylinder causing said rod to be extended lifting said front end of said next following case over said abutment.

* * * * *